United States Patent [19]

Overturf

[11] Patent Number: 4,897,069

[45] Date of Patent: Jan. 30, 1990

[54] TOY HOOP AND GUIDE STICK

[76] Inventor: Sterlin U. Overturf, 808 W. 32nd St., Baltimore, Md. 21211

[21] Appl. No.: 320,516

[22] Filed: Mar. 8, 1989

[51] Int. Cl.[4] ..... A63H 33/02

[52] U.S. Cl. ..... 446/219; 446/450

[58] Field of Search ..... 446/450, 411, 236, 265, 446/452, 453, 219, 266, 412

[56] References Cited

U.S. PATENT DOCUMENTS

| | | | |
|---|---|---|---|
| D. 211,797 | 7/1968 | Fisher | 446/450 X |
| D. 214,675 | 7/1969 | Moore | 446/450 X |
| 3,167,881 | 2/1965 | Mazzadra | 446/266 |
| 3,918,708 | 11/1975 | Augusta | 446/265 X |
| 3,956,851 | 5/1976 | Tapinekis | 446/450 X |
| 4,052,814 | 10/1977 | Hall | 446/450 |
| 4,070,791 | 1/1978 | Dill | 446/450 |

*Primary Examiner*—Mickey Yu

*Attorney, Agent, or Firm*—Jerry T. Kearns

[57] ABSTRACT

A toy hoop and guide stick allows the hoop to be rolled along and controlled by an individual through use of the guide stick. A rectangular channel member is secured to an end portion of the guide stick and has a width equal to about twice the width of the hoop. This allows a wide variety of maneuvers and tricks to be performed by manipulating the hoop. In a second embodiment, the circular hoop has a hollow circular interior track receiving a plurality of elongated rolling members. The hoop is formed from a transparent material to allow observation of the rolling members. The rolling members including a phosphorescent material.

1 Claim, 3 Drawing Sheets

TOY HOOP AND GUIDE STICK

BACKGROUND OF THE INVENTION

1. Field of the Invention

The present invention relates to toy hoops and guide sticks, and more particularly pertains to an improved guide stick construction which enables a wide variety of maneuvers and tricks to be performed on a rolling hoop. Toy rolling hoops and guide sticks have been known for many years as toys for the amusement of children. With the increasing knowledge of the importance of physical exercise to the maintenance of good health, recent attention has been given to the use of such toy hoops and guide sticks as providing entertaining exercise devices.

2. Description of the Prior Art

Various types of toy hoops and guide sticks are known in the prior art. A typical example of such a toy hoop and guide stick is to be found in U.S. Pat. No. 3,254,443, which issued to M. Olson on June 7, 1966. This patent discloses an elongated guide stick having a bifurcated end portion for manipulation of a circular hoop. The circular hoop is formed from a plastic material with a frictional connection fitting. U.S. Pat. No. 3,788,000, which issued to J. Jenkins on Jan. 29, 1974, discloses a toy hoop and guide stick which utilizes an elongated wooden stick provided with a transversely extending wire hoop engaging element. U.S. Pat. No. 4,091,564, which issued to I. Jasinski on May 30, 1978, discloses a toy circular disk and an associated elongated guide stick. The guide stick has a rectangular channel member having a width only slightly greater than the width of the associated disk. U.S. Pat. No. 4,453,341, which issued to E. Klukos on June 12, 1984, discloses a toy circular hoop and associated guide stick. The guide stick has a bifurcated end portion for manipulation of the hoop. U.S. Pat. No. 4,616,830, which issued to A. Moore on Oct. 14, 1986, discloses a circular disk-shaped wheel adapted for manipulation by an elongated guide stick. A U-shaped wire member is secured adjacent one end of the guide stick.

While the above mentioned devices are suited for their intended usage, none of these devices include a rectangular channel member having two parallel side walls separated by an extent equal to about twice the width of the associated circular hoop. This feature allows a variety of maneuvers and tricks to be performed through manipulation of the hoop. These maneuvers are not capable of being performed bY the aforementioned prior art devices. An additional feature of the present invention, not disclosed by any of the aforementioned prior art devices is the provision of a circular hoop having a hollow circular interior portion forming a track for the reception of a plurality of rolling members. Inasmuch as the art is relatively crowded with respect to these various types of toy hoops and guide sticks, it can be appreciated that there is a continuing need for and interest in improvements to such toy hoops and guide sticks, and in this respect, the present invention addresses this need and interest.

SUMMARY OF THE INVENTION

In view of the foregoing disadvantages inherent in the known types of toy hoops and guide sticks now present in the prior art, the present invention provides an improved toy hoop and guide stick. As such, the general purpose of the present invention, which will be described subsequently in greater detail, is to provide a new and improved toy hoop and guide stick which has all the advantages of the prior art toy hoops and guide sticks and none of the disadvantages.

To attain this, representative embodiments of the concepts of the present invention are illustrated in the drawings and make use of a toy hoop and guide stick which allows the hoop to be rolled along and controlled by an individual through use of the guide stick. A rectangular channel member is secured to an end portion of the guide stick and has a width equal to about twice the width of the hoop. This allows a wide variety of maneuvers and tricks to be performed by manipulating the hoop. In a second embodiment, the circular hoop has a hollow circular interior track receiving a plurality of elongated rolling members. The hoop is formed from a transparent material to allow observation of the rolling members.

There has thus been outlined, rather broadly, the more important features of the invention in order that the detailed description thereof that follows maY be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy hoop and guide stick which has all the advantages of the prior art toy hoops and guide sticks and none of the disadvantages.

It is another object of the present invention to provide a new and improved toy hoop and guide stick which may be easily and efficiently manufactured and marketed.

It is a further object of the present invention to provide a new and improved toy hoop and guide stick which is of a durable and reliable construction.

An even further object of the present invention is to provide a new and improved toy hoop and guide stick which is susceptible of a low cost of manufacture with regard to both materials and labor, and which accordingly is then susceptible of low prices of sale to the consuming public, thereby making such toy hoops and guide sticks economically available to the buying public.

Still yet another object of the present invention is to provide a new and improved toy hoop and guide stick which provides in the apparatuses and methods of the prior art some of the advantages thereof, while simultaneously overcoming some of the disadvantages normally associated therewith.

Still another object of the present invention is to provide a new and improved toy hoop and guide stick having a rectangular channel member for manipulation of the hoop to perform a wide variety of maneuvers and tricks.

Yet another object of the present invention is to provide a new and improved toY hoop and guide stick which provides an amusing fitness exercise device.

Even still another object of the present invention is to provide a new and improved toy hoop and guide stick which utilizes a hoop having a hollow interior portion receiving a plurality of freely rotatable roller members.

These together with other objects of the invention, along with the various features of novelty which characterize the invention, are pointed out with particularitY in the claims annexed to and forming a part of this disclosure. For a better understanding of the invention, its operating advantages and the specific objects attained bY its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
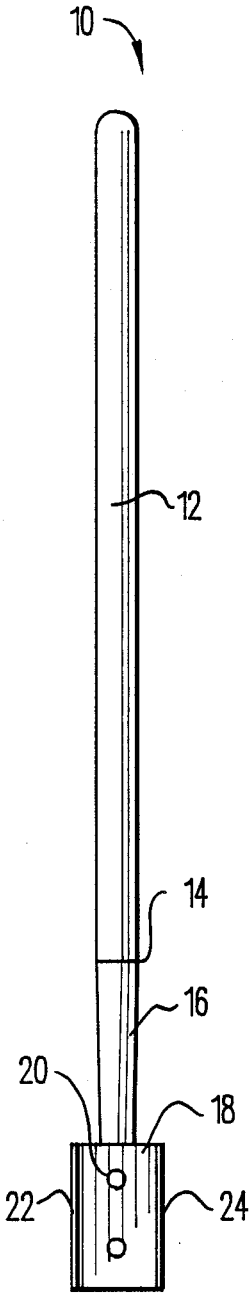
FIG. 1 is a front view of the guide stick according to the present invention.

With reference now to the drawings, and in particular to FIG. 1 thereof, a new and improved toy hoop and guide stick embodying the principles and concepts of the present invention and generally designated by the reference numeral 10 will be described.

More specifically, it will be noted that the first embodiment 10 of the invention includes an elongated guide stick having a handle portion 12 connected at a joint 14 to a tapering end portion 16. The handle portion 12 and end portion 16 may be integrally formed if desired. The end portion 16 is provided with a rectangular channel member 18 having two parallel side walls 22 and 24 separated by an extent W of about $2\frac{1}{4}$ inches. Fasteners 20, for example rivets or screws are utilized to secure the guide member 18 to the end portion 16. The entire length of the guide stick 10 is preferably about 28 inches.

Figure 2:
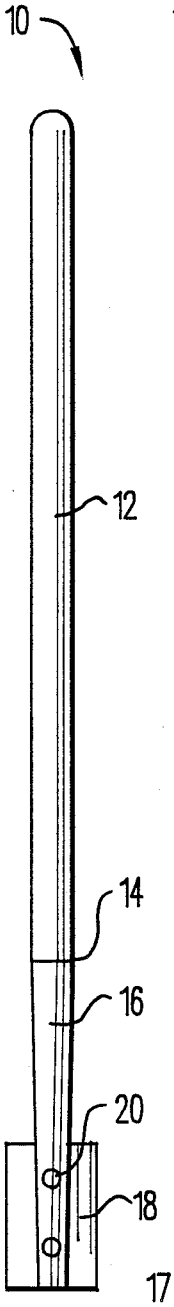
FIG. 2 is a back view of the guide stick.

FIG. 2 illustrates a back view of the guide stick 10.

Figure 3:
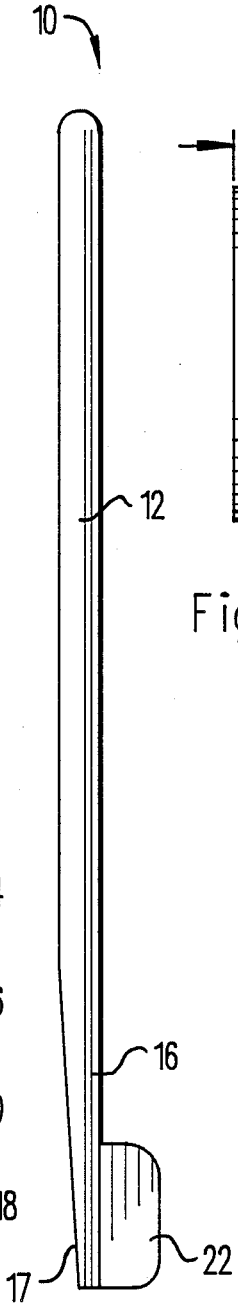
FIG. 3 is a side view of the guide stick.

FIG. 3 illustrates a side view of the guide stick 10. The corner portions of the parallel side walls 22 and 24 are preferably radiused to prevent injury to individuals. As illustrated in FIG. 3, the end portion 16 may have a tapered back surface. This serves to provide clearance between the tapered back surface 17 and the ground during certain manipulations of a rolling hoop.

Figure 4:
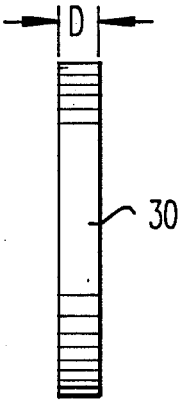
FIG. 4 is a side view of the hoop according to a first embodiment of the present invention.

FIG. 4 illustrates a side view of a circular hoop 30 adapted for manipulation by the guide stick 10. The hoop 30 may be formed from a metal or plastic material and preferably has a width D of about 1 inch.

Figure 5:
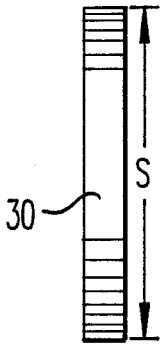
FIG. 5 is an opposite side view of the hoop.

As shown in FIG. 5, the diameter S of the hoop 30 is preferably $8\frac{3}{4}$ inches.

Figure 6:
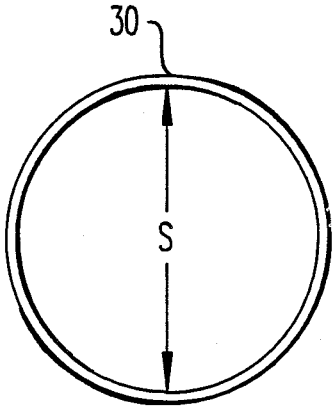
FIG. 6 is a front view of the hoop.

FIG. 6 provides a front view of the hoop 30. The thickness of the material utilized to form the hoop 30 is preferably about $\frac{1}{8}$ of an inch.

Figure 7:
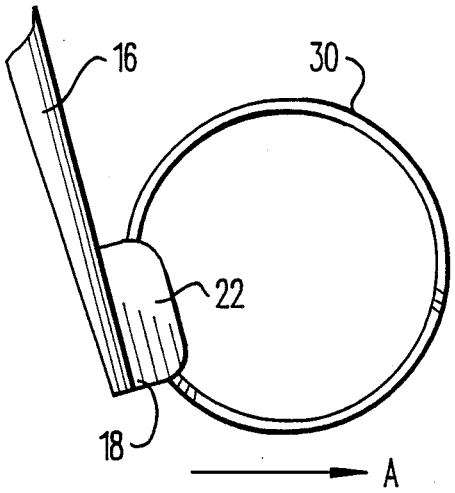
FIG. 7 illustrates the hoop being pushed forwardly by the guide stick.

FIG. 7 illustrates the position of the end portion of the guide stick 16 and attached guide member 18 in contact with the hoop 30 for rolling the hoop 30 in a forward direction as indicated by the arrow A. In use, an individual grasps the upper portion of the handle 12 illustrated in FIG. 1 and walks or runs behind the hoop 30.

Figure 8:
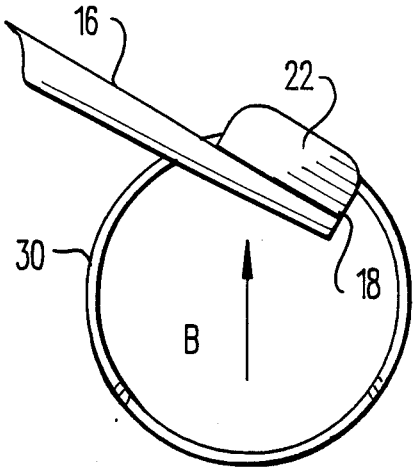
FIG. 8 illustrates the hoop being lifted by the guide stick.

FIG. 8 illustrates the guide member 18 in position for lifting the hoop 30. This maneuver is utilized in performing various tricks or to lift the hoop 30 over curbs or other obstacles. The width W of the guide member 18 (FIG. 1) is approximately twice the width D (FIG. 4) of the hoop 30. This configuration enables the lifting operation of the hoop 30 in the direction of the arrow B.

Figure 9:
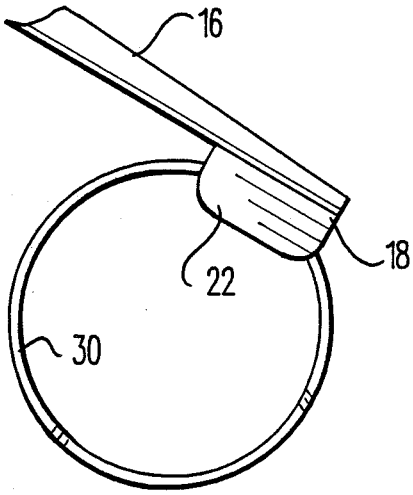
FIG. 9 illustrates the rolling motion of the hoop being stopped by the guide stick.

FIG. 9 illustrates the positioning of the guide member 18 in contact with an upper portion of the hoop 30 to slow or stop the rolling of the hoop 30.

Figure 10:
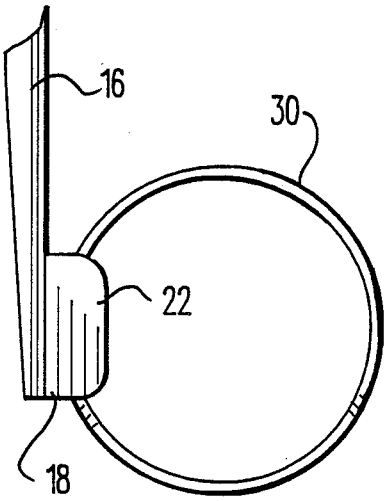
FIG. 10 illustrates the guide stick being applied to stabilize lateral wobbling during rolling of the hoop.

FIG. 10 illustrates the guide member 18 being applied to the back portion of the hoop 30 to stabilize the hoop 30 against lateral wobbling motion during the forward rolling of the hoop 30. The hoop 30 may be caused to flutter slightlY from side to side by sharply striking the back of the hoop 30 with the guide 18. A variety of tricks and maneuvers may be performed by combining the various maneuvers illustrated in FIGS. 7 through 10.

Figure 11:
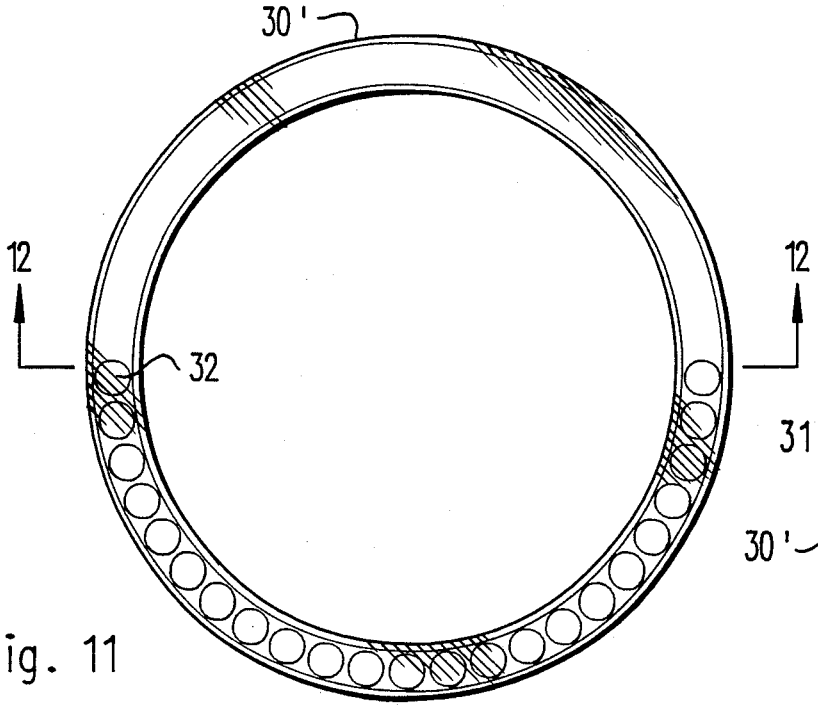
FIG. 11 is a front view of a hoop according to a second embodiment of the present invention.

FIG. 11 is a front view of a modified hoop 30' according to a second embodiment of the present invention. The hoop 30' is preferably formed from a transparent plastic material and has a hollow circular interior portion forming a track which receives a plurality of rolling elements 32.

Figure 12:
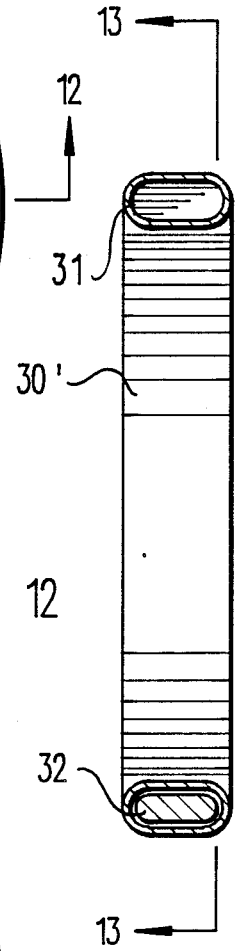
FIG. 12 is a cross sectional view, taken along line 12—12 of FIG. 11.

As shown in the cross sectional view of FIG. 12, the rolling elements 32 have an elongated generally oval configuration. The rolling elements 32 may be formed from metal or plastic and may be colored or tinted in a variety of colors to provide an amusing visual effect during rolling of the hoop 30'. The rolling elements 32 are received for free rolling motion within the hollow circular guide track 31 of the hoop 30'.

Figure 13:
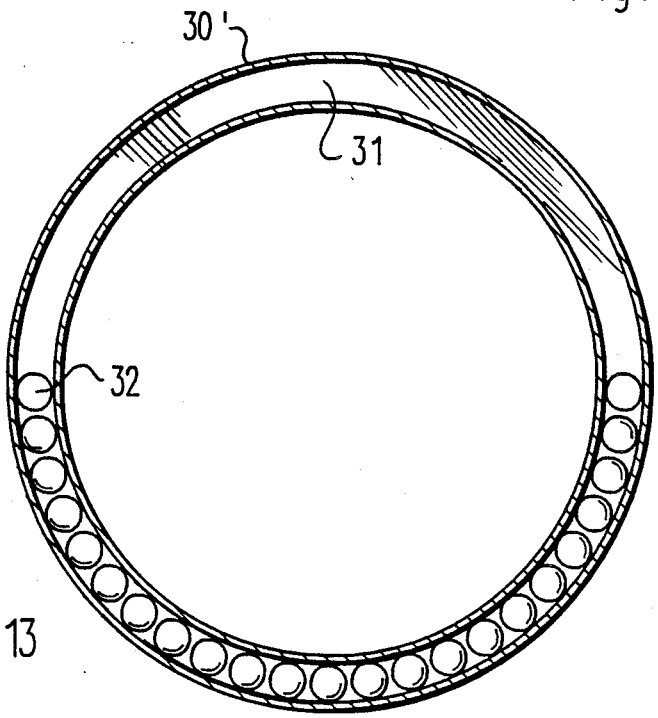
FIG. 13 is a cross sectional view, taken along line 13—13 of FIG. 12.

FIG. 13 provides a cross sectional view, taken along line 13—13 of FIG. 12 which further illustrates the rolling elements 32 received within the track 31. The rolling elements 32 may be also impregnated or painted with a phosphorescent paint for use after dark. The rolling elements 32 provide additional stability to the hoop 30' during rolling and provide a rattling sound effect. Also, the use of various paint or other pigmentation may be utilized to provide a visual rolling effect.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readilY occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A toy hoop and guide stick, comprising:

a circular hoop having a predetermined width;

an elongated guide stick;

a rectangular channel member secured adjacent one end of said guide stick;

said channel member having two parallel side walls separated by an extent equal to about twice the width of said circular hoop;

said circular hoop formed from a transparent material and having a hollow interior portion forming a continuous circular track; and a plurality of rolling members received in said track, said rolling members each having an elongated generally oval configuration, extending substantially entirely across the width of said hoop and including a phosphorescent material.

* * * * *